US011322327B2

(12) United States Patent
Miyake et al.

(10) Patent No.: US 11,322,327 B2
(45) Date of Patent: May 3, 2022

(54) RELAY

(71) Applicant: OMRON Corporation, Kyoto (JP)

(72) Inventors: Ayaka Miyake, Kikuchi (JP); Tatsuro Kitagawa, Koshi (JP); Tamako Oyama, Kumamoto (JP); Takuya Kondo, Fukuoka (JP)

(73) Assignee: OMRON CORPORATION, Kyoto (JP)

( * ) Notice: Subject to any disclaimer, the term of this patent is extended or adjusted under 35 U.S.C. 154(b) by 16 days.

(21) Appl. No.: 16/979,865

(22) PCT Filed: Feb. 18, 2019

(86) PCT No.: PCT/JP2019/005931
§ 371 (c)(1),
(2) Date: Sep. 11, 2020

(87) PCT Pub. No.: WO2019/187780
PCT Pub. Date: Oct. 3, 2019

(65) Prior Publication Data

US 2021/0366678 A1 Nov. 25, 2021

(30) Foreign Application Priority Data

Mar. 27, 2018 (JP) ..... JP2018-060044

(51) Int. Cl.
*H01H 50/64* (2006.01)
*H01H 50/24* (2006.01)

(52) U.S. Cl.
CPC ..... *H01H 50/642* (2013.01); *H01H 50/24* (2013.01); *H01H 50/644* (2013.01)

(58) Field of Classification Search
CPC .... H01H 50/24; H01H 50/642; H01H 50/644; H01H 50/026; H01H 2050/028; H01H 50/26; H01H 50/641
See application file for complete search history.

(56) References Cited

U.S. PATENT DOCUMENTS 5,204,647 A * 4/1993 Mitsuki ..... H01H 50/043 335/80
7,859,371 B2 * 12/2010 Takano ..... H01H 50/30 335/78

(Continued)

FOREIGN PATENT DOCUMENTS

CN 1224915 A 8/1999
CN 1499556 A 5/2004

(Continued)

OTHER PUBLICATIONS

Machine translation of JP2000076977A (Year: 2000).*

(Continued)

*Primary Examiner* — Bernard Rojas
(74) *Attorney, Agent, or Firm* — Shinjyu Global I:

(57) ABSTRACT

A relay includes a fixed terminal, a fixed contact connected to the fixed terminal, a movable contact piece facing the fixed terminal, a movable contact, a drive unit including a coil and an armature operated by electromagnetic force generated from the coil, a card, and a wall disposed between the armature and the card. The movable contact is connected to the movable contact piece and faces the fixed contact. The card is disposed between the drive unit and the movable contact piece, and transmits an operation of the armature to the movable contact piece. The card includes a card body, a contact part, and a protrusion. The card body is disposed between the wall and a movable contact piece. The contact part extends from the card body toward the armature. The protrusion protrudes from the card body toward the wall and is disposed on a side of the contact part.

12 Claims, 12 Drawing Sheets

(56) References Cited

U.S. PATENT DOCUMENTS

| | | | | |
|---|---|---|---|---|
| 8,102,227 | B2 * | 1/2012 | Fujiwara | H01H 50/643 335/78 |
| 2004/0130419 | A1 | 7/2004 | Sanada et al. | |
| 2005/0040920 | A1 | 2/2005 | Takano et al. | |
| 2013/0293324 | A1 * | 11/2013 | Fujimoto | H01H 50/026 335/156 |
| 2021/0366678 | A1 * | 11/2021 | Miyake | H01H 50/641 |

FOREIGN PATENT DOCUMENTS

| | | | |
|---|---|---|---|
| CN | 201667321 | U | 12/2010 |
| CN | 103367042 | A | 10/2013 |
| CN | 203288516 | U | 11/2013 |
| CN | 203367171 | U | 12/2013 |
| CN | 107305825 | A | 10/2017 |
| CN | 107644788 | A | 1/2018 |
| CN | 207052535 | U | 2/2018 |
| DE | 7309137 | U | 7/1973 |
| JP | 9-320441 | A | 12/1997 |
| JP | 09-320441 | A | 12/1997 |
| JP | 11-213839 | A | 8/1999 |
| JP | 2000-76977 | A | 3/2000 |
| JP | 2004-158382 | A | 6/2004 |
| JP | 2012-160325 | A | 8/2012 |
| JP | 2013-218883 | A | 10/2013 |

OTHER PUBLICATIONS

International Search Report of International Application No. PCT/JP2019/005931 dated Apr. 23, 2019.
Written Opinion of the International Searching Authority of International Application No. PCT/JP2019/005931 dated Apr. 23, 2019.
Supplementary European search report of the corresponding European Application No. 19775648.9 dated Nov. 30, 2021.
The Office Action for the corresponding Chinese application No. 201980016501.X, dated Dec. 27, 2021.

* cited by examiner

RELAY

CROSS-REFERENCE TO RELATED APPLICATION

This application is the U.S. National Phase of International Application No. PCT/JP2019/005931, filed on Feb. 18, 2019. This application claims priority to Japanese Patent Application No. 2018-060044, filed Mar. 27, 2018. The contents of those applications are incorporated by reference herein in their entireties.

FIELD

The present invention relates to a relay.

BACKGROUND

In a relay, an armature is operated by electromagnetic force generated from a coil, and the operation of the armature is transmitted to a movable contact piece to open or close the contact. For example, the relay disclosed in Japanese Patent Application Publication No. 2012-160325A has a card that is disposed between an armature and a movable contact piece. Upon the armature being operated by electromagnetic force generated from a coil, the operation of the armature is transmitted to the movable contact piece via the card.

SUMMARY

In this type of a relay as above, it is preferable that an insulation distance between the movable contact piece and the armature is large in order to improve impact-resistance voltage performance. However, as a distance between the movable contact piece and the armature is increased, the relay becomes larger in size.

An object of the present invention is to increase an insulation distance between the movable contact piece and the armature while suppressing an increase in the size of the relay.

The relay according to a first aspect includes a fixed terminal, a fixed contact, a movable contact piece, a movable contact, a drive unit, a card, and a wall. The fixed contact is connected to the fixed terminal. The movable contact piece is disposed to face the fixed terminal. The movable contact is connected to the movable contact piece and is disposed to face the fixed contact. The drive unit includes a coil and an armature. The armature is operable by electromagnetic force that is generated by the coil. The card is disposed between the drive unit and the movable contact piece and transmits an operation of the armature to the movable contact piece. The wall is disposed between the armature and the card.

The card includes a card body, a contact part, and a protrusion. The card body is disposed between the wall and the movable contact piece. The contact part extends from the card body toward the armature. The protrusion protrudes from the card body toward the wall and is disposed on a side of the contact part.

In the relay according to this aspect, the wall is disposed between the armature and the card. With the configuration, it is possible to increase an insulation distance between the movable contact piece and the armature while suppressing an increase in the size of the relay. Further, the card is provided with a protrusion protruding from the card body toward the wall. With the configuration, it is possible to further increase the insulation distance between the movable contact piece and the armature while suppressing an increase in the size of the relay.

The relay may further include a base that supports the fixed terminal, the movable contact piece, and the drive unit. The protrusion may extend in an up-down direction. The upward direction means a direction in which the movable contact piece extends from the base, and the downward direction means an opposite direction of the upward direction. In this case, the protrusion has a shape that extends in the up-down direction, and therefore, the insulation distance between the movable contact piece and the armature can be further increased.

The protrusion may extend from a location above the contact part to a location below the contact part. In this case, the protrusion has a shape that extends greatly in the up-down direction, and therefore, the insulation distance between the movable contact piece and the armature can be further increased.

The wall may include an upper wall portion located above the contact part. The protrusion may extend from a location above the lower end of the upper wall portion to a location below the lower end of the upper wall portion. In this case, the protrusion has a shape that extends greatly in the up-down direction, and therefore, the insulation distance between the movable contact piece and the armature can be further increased.

The wall may further include a side wall portion. The side wall portion may extend from the upper wall portion through the side of the contact part to a location below the contact part. At least a part of the protrusion may be disposed to face the side wall portion. In this case, the side wall portion extends through the side of the contact part, and therefore, the insulation distance between the movable contact piece and the armature can be increased. Further, at least a part of the protrusion is disposed to face the side wall portion, and therefore, the insulation distance between the movable contact piece and the armature can be further increased.

When viewed in a direction from the movable contact piece toward the drive unit, at least a part of the protrusion may overlap the wall. In this case, the insulation distance between the movable contact piece and the armature can be further increased.

The contact part may include a central contact portion, a first extending portion, and a second extending portion. The first extending portion may be disposed on one side of the central contact portion and may extend toward the drive unit further than the central contact portion does. The second extending portion may be disposed on the other side of the central contact portion and may extend toward the drive unit further than the central contact portion does. The armature may be configured to operate by the electromagnetic force to press the central contact portion. In this case, the armature can be held at both sides by the first extending portion and the second extending portion. Therefore, the armature can press the central contact portion of the card in a stable manner.

The center contact portion may have a shape that is convexly curved toward the armature. In this case, the armature can press the central contact portion of the card in a more stable manner.

The drive unit may further include an iron core inserted in the coil. The armature may include a first portion, a second portion, and a third portion. The first portion may be disposed to face the iron core. The second portion may be disposed to face the contact part. The third portion may be disposed between the first portion and the second portion.

The second portion may have a smaller width than the first portion. In this case, a width of the second portion facing the contact part of the card is smaller than the width of the first portion. Therefore, the insulation distance between the movable contact piece and the armature can be further increased. Moreover, since the width of the first portion facing the iron core can be still large, magnetic loss in the armature can be reduced.

The second portion may have a smaller width than the third portion. In this case, the third portion can secure a large width for connecting the first portion and the second portion. Therefore, it is possible to suppress a decrease in strength of the armature.

The second portion may include a first recess and a second recess. The first extending portion may be disposed in the first recess. The second extending portion may be disposed in the second recess. In this case, it is possible to dispose the first extending portion and the second extending portion on both sides of the armature while reducing the width of the second portion. As a result, while an increase in the size of the relay is suppressed, the insulation distance between the movable contact piece and the armature can be increased.

The relay according to a second aspect comprises a fixed terminal, a fixed contact, a movable contact piece, a movable contact, a drive unit, a card, and a wall. The fixed contact is connected to the fixed terminal. The movable contact piece is disposed to face the fixed terminal. The movable contact is connected to the movable contact piece and is disposed to face the fixed contact. The drive unit includes a coil and an armature. The armature is operable by electromagnetic force that is generated by the coil. The card is disposed between the drive unit and the movable contact piece and transmits an operation of the armature to the movable contact piece. The wall is disposed between the armature and the card. The wall includes a wall body and a protrusion. The wall body extends in a direction intersecting a direction from the card toward the drive unit. The protrusion projects from the wall body toward the card.

In the relay according to this aspect, the wall is disposed between the armature and the card. Accordingly, it is possible to increase an insulation distance between the movable contact piece and the armature while suppressing an increase in the size of the relay. Further, the wall includes a protrusion protruding from the wall body toward the card. With the configuration, the insulation distance between the movable contact piece and the armature can be further increased while an increase in the size of the relay is suppressed.

The relay may further include a base that supports the fixed terminal, the movable contact piece, and the drive unit.

The protrusion may extend in an up-down direction. The upward direction means a direction in which the movable contact piece extends from the base, and the downward direction means an opposite direction to the upward direction. In this case, the protrusion has a shape that extends in the up-down direction, and therefore, the insulation distance between the movable contact piece and the armature can be further increased.

The card may include a card body and a contact part. The card body may be disposed between the wall and the movable contact piece. The contact part may extend from the card body toward the armature to contact the armature. The wall body may include an upper wall portion and a side wall portion. The upper wall portion may be located above the contact part. The side wall portion may extend from the upper wall portion through a side of the contact part to a location below the contact part. The protrusion may extend from a location above a lower end of the upper wall portion to a location below the lower end of the upper wall portion. In this case, the side wall portion extends through a side of the contact part, and therefore, the insulation distance between the movable contact piece and the armature can be extended. Further, since the protrusion extends greatly in the up-down direction, the insulation distance between the movable contact piece and the armature can be further increased.

The protrusion may extend from a location above the contact part to a location below the contact part. In this case, since the protrusion extends greatly in the up-down direction, the insulation distance between the movable contact piece and the armature can be further increased.

DETAILED DESCRIPTION

Figure 1:
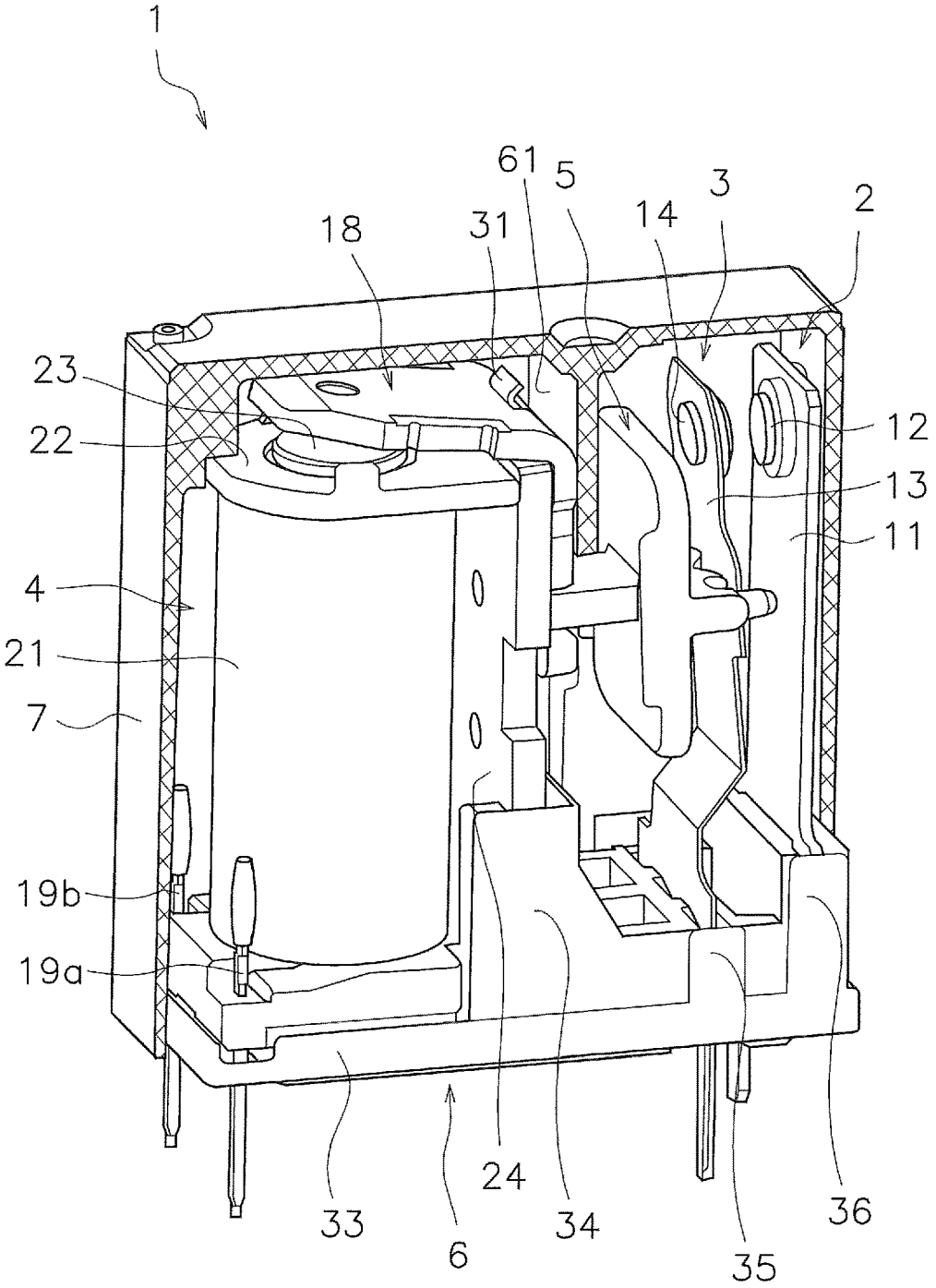
FIG. 1 is a perspective view of the relay according to an embodiment.
Figure 2:
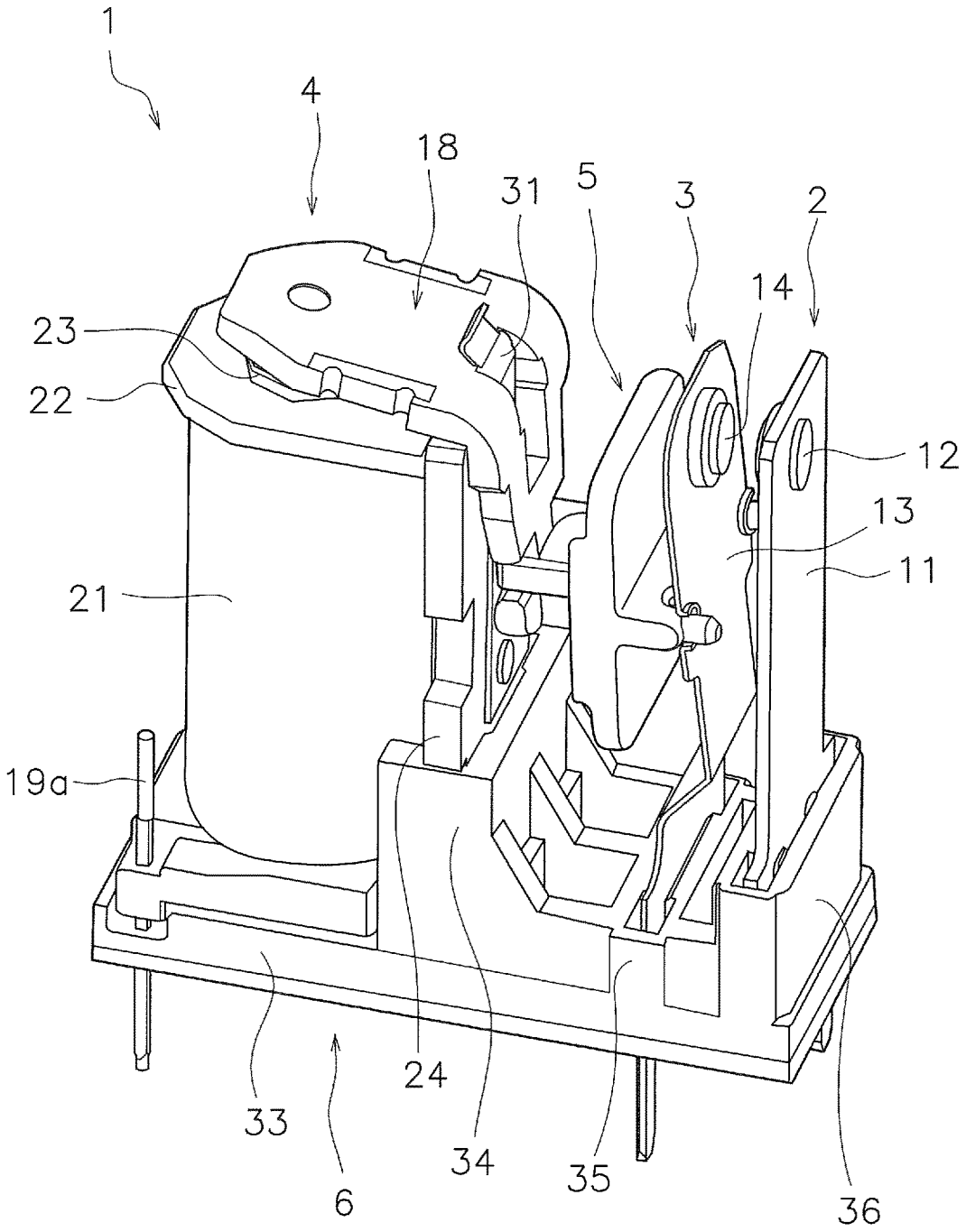
FIG. 2 is a perspective view of the relay.
Figure 3:
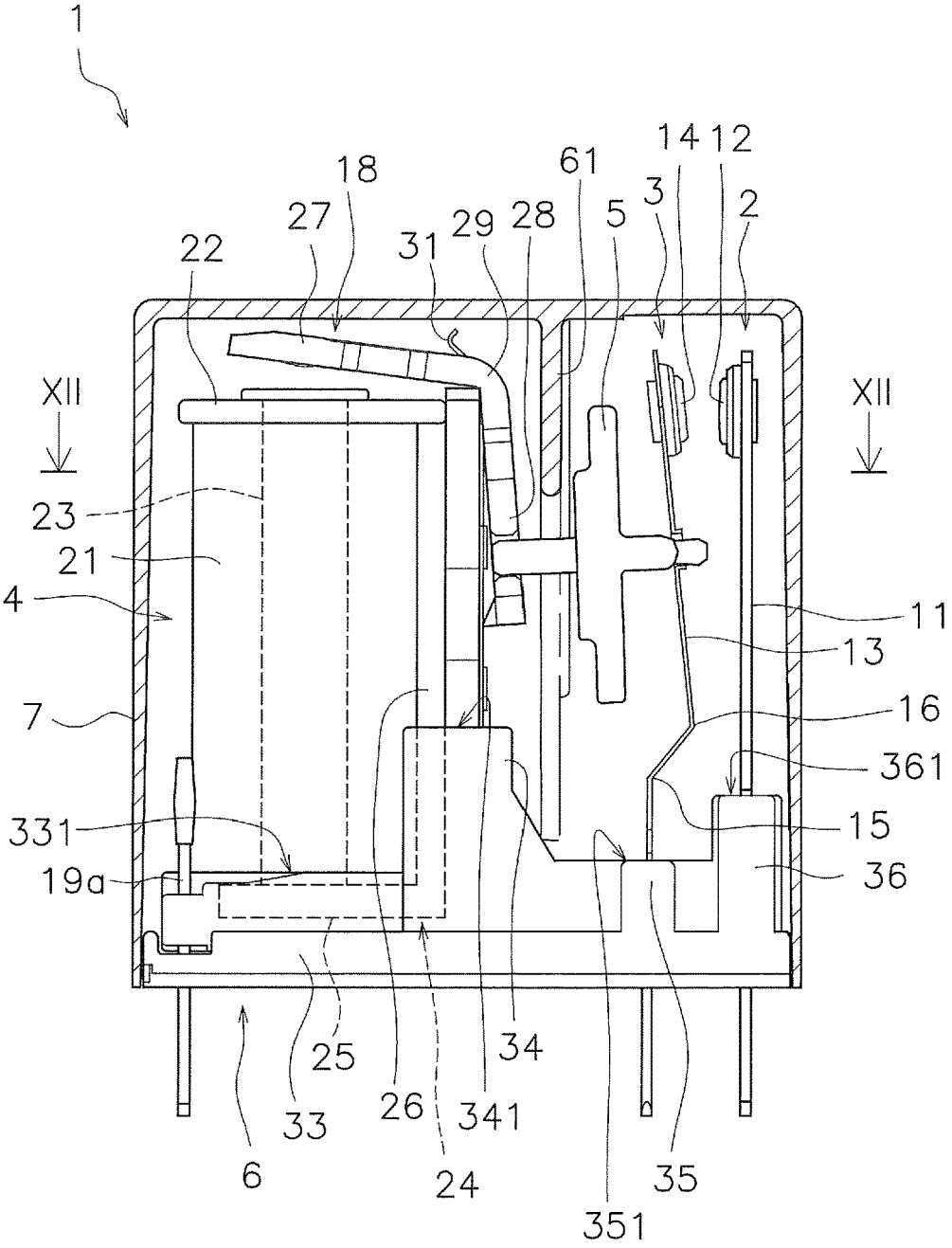
FIG. 3 is a front view of the relay.

Hereinafter, an example of the relay according to the embodiment will be described with reference to the drawings. FIGS. 1 and 2 are perspective views showing a relay 1 according to the embodiment. FIG. 3 is a front view of the relay 1. As illustrated in FIGS. 1 to 3, the relay 1 includes a fixed contact unit 2, a movable contact unit 3, a drive unit 4, a card 5, a base 6, and a case 7. In FIGS. 1 and 3, the case 7 is illustrated in cross section. In FIG. 2, the case 7 is not shown.

The fixed contact unit 2 includes a fixed terminal 11 and a fixed contact 12. The fixed terminal 11 and the fixed contact 12 are made of a conductive material. The fixed contact 12 is attached to the fixed terminal 11. The fixed terminal 11 is supported by the base 6. One end of the fixed terminal 11 projects from the base 6 to the outside of the relay 1. The other end of the fixed terminal 11 is located inside the case 7 and has the fixed contact 12 attached thereto.

The movable contact unit 3 includes a movable contact piece 13 and a movable contact 14. The movable contact piece 13 and the movable contact 14 are made of a conductive material. The movable contact piece 13 is supported by the base 6. One end of the movable contact piece 13 projects from the base 6 to the outside of the relay 1. The other end of the movable contact piece 13 is located inside the case 7 and has a movable contact 14 attached thereto. The movable contact piece 13 is made of an elastic material. The movable contact piece 13 is disposed between the fixed terminal 11 and the drive unit 4. The movable contact piece 13 is disposed to face the fixed terminal 11. The movable contact 14 is disposed to face the fixed contact 12.

In the following description, the direction in which the movable contact piece 13 extends from the base 6 is referred to as "upward" and its opposite direction is referred to as "downward" within the case 7. The definition of these directions is used for convenience in description, and does not limit the orientation of the relay 1 and such other orientations.

The movable contact piece 13 and the fixed terminal 11 extend upward from the base 6. As illustrated in FIG. 3, the movable contact piece 13 includes a first bend 15 and a second bend 16. The second bend 16 is located above the first bend 15. The movable contact piece 13 bends toward the fixed terminal 11 at the first bend 15. The movable contact piece 13 bends upward at the second bend 16.

The drive unit 4 generates a driving force for driving the movable contact unit 3. The drive unit 4 is supported by the base 6. The drive unit 4 includes a coil 21, a bobbin 22, an iron core 23, a yoke 24, and an armature 18. The coil 21 is wound around the bobbin 22. The axis of the coil 21 extends in the up-down direction. The coil 21 is connected to the coil terminals 19*a* and 19*b*. The coil terminals 19*a* and 19*b* are supported by the bobbin 22. The iron core 23 is inserted in the bobbin 22.

As illustrated in FIG. 3, the yoke 24 is bent in an L shape. The yoke 24 is connected to the iron core 23. Specifically, the yoke 24 has a yoke bottom 25 and a yoke side 26. The yoke bottom 25 is disposed below the coil 21. The lower end of the iron core 23 projects downward from the bobbin 22, and the yoke bottom 25 is connected to the lower end of the iron core 23. The yoke side 26 is disposed on a side of the coil 21. The yoke side 26 extends in the up-down direction.

The armature 18 is rotatably supported by the upper end of the yoke 24. The armature 18 is operated by electromagnetic force generated from the coil 21. Specifically, the armature 18 is rotatably supported on the upper end of the yoke side 26. The armature 18 is bent in an L shape. As illustrated in FIG. 3, the armature 18 includes a first portion 27, a second portion 28, and a third portion 29. The first portion 27 is disposed above the iron core 23. The first portion 27 is disposed to face the iron core 23. The second portion 28 is disposed to face the card 5. The third portion 29 is disposed between the first portion 27 and the second portion 28. The armature 18 has a bend at the third portion 29.

A hinge spring 31 is attached to the armature 18 and the yoke 24. The hinge spring 31 is made of an elastic material. The hinge spring 31 biases the armature 18 in a direction in which the first portion 27 contacts the iron core 23.

The base 6 is made of an insulating material. The base 6 is made of resin. The base 6 may be formed of a material other than resin. The base 6 supports the fixed contact unit 2, the movable contact unit 3, and the drive unit 4. The base 6 includes a coil placement portion 33, a yoke support portion 34, a contact piece support portion 35, and a fixed terminal support portion 36. The coil placement portion 33 is located below the coil 21 and the bobbin 22. The yoke support portion 34 supports the yoke 24. The contact piece support portion 35 supports the movable contact piece 13. The fixed terminal support portion 36 supports the fixed terminal 11.

The yoke support portion 34 covers a lower part of the yoke 24 on the movable contact piece 13 side. As illustrated in FIG. 3, the upper surface 341 of the yoke support portion 34 is located higher than the upper surface 331 of the coil placement portion 33. The upper surface 341 of the yoke support portion 34 is located higher than the upper surface 351 of the contact piece support portion 35. The upper surface 341 of the yoke support portion 34 is located higher than the upper surface 361 of the fixed terminal support portion 36. The upper surface 341 of the yoke support portion 34 is located higher than the first bend 15 of the movable contact piece 13.

Figure 4:
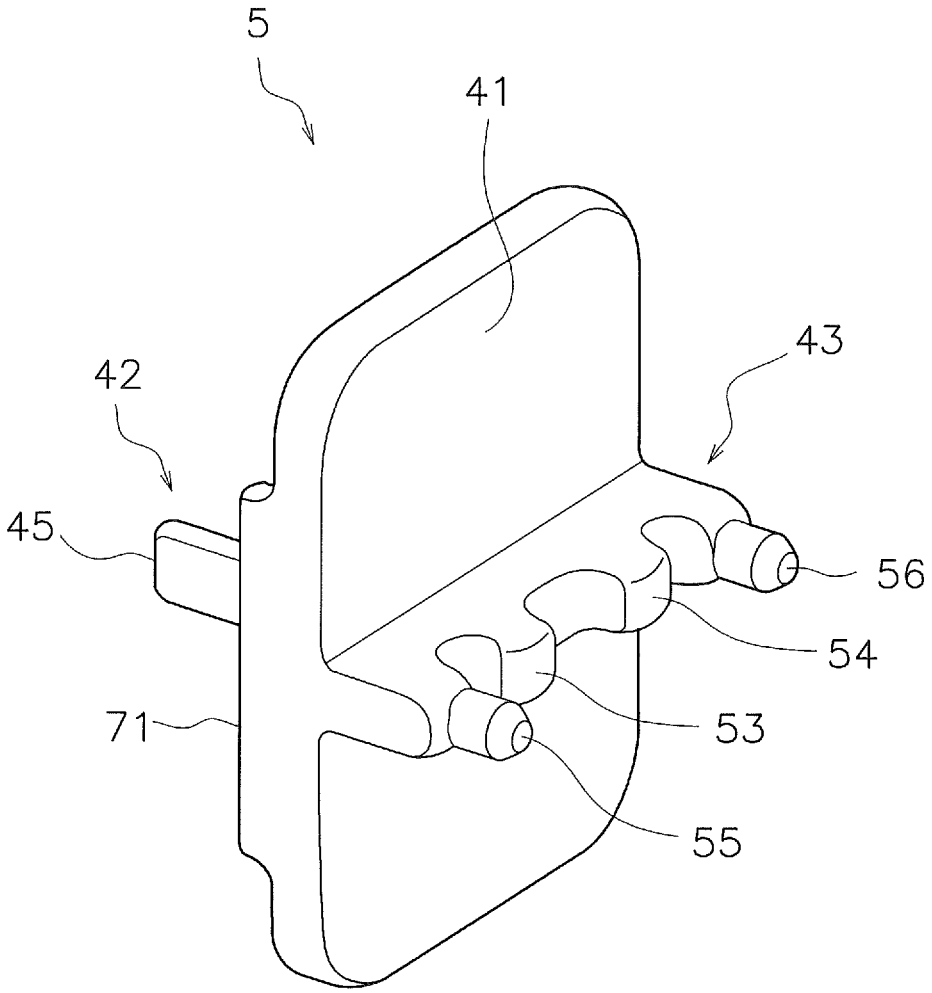
FIG. 4 is a perspective view of a card.
Figure 5:
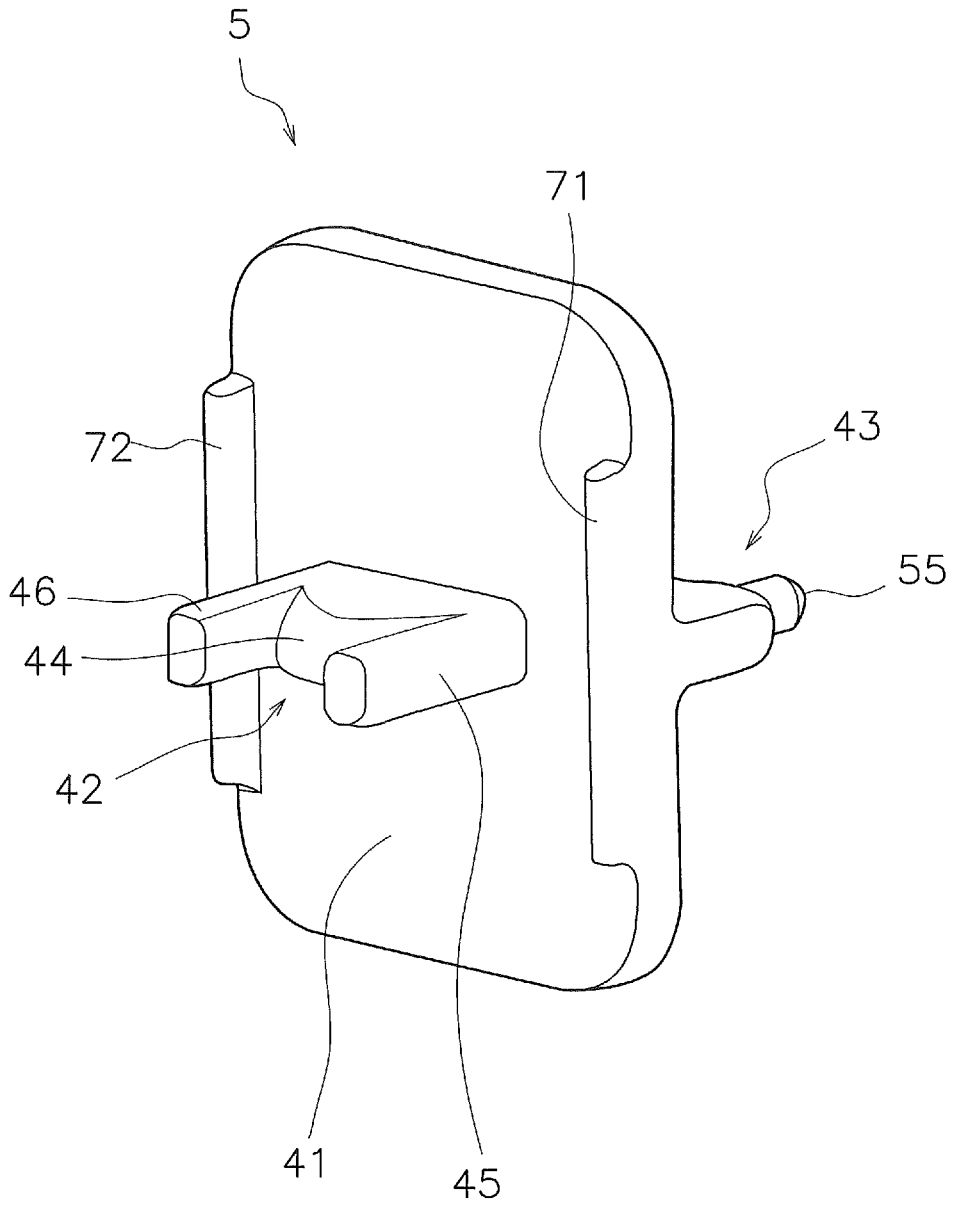
FIG. 5 is a perspective view of the card.
Figure 6:
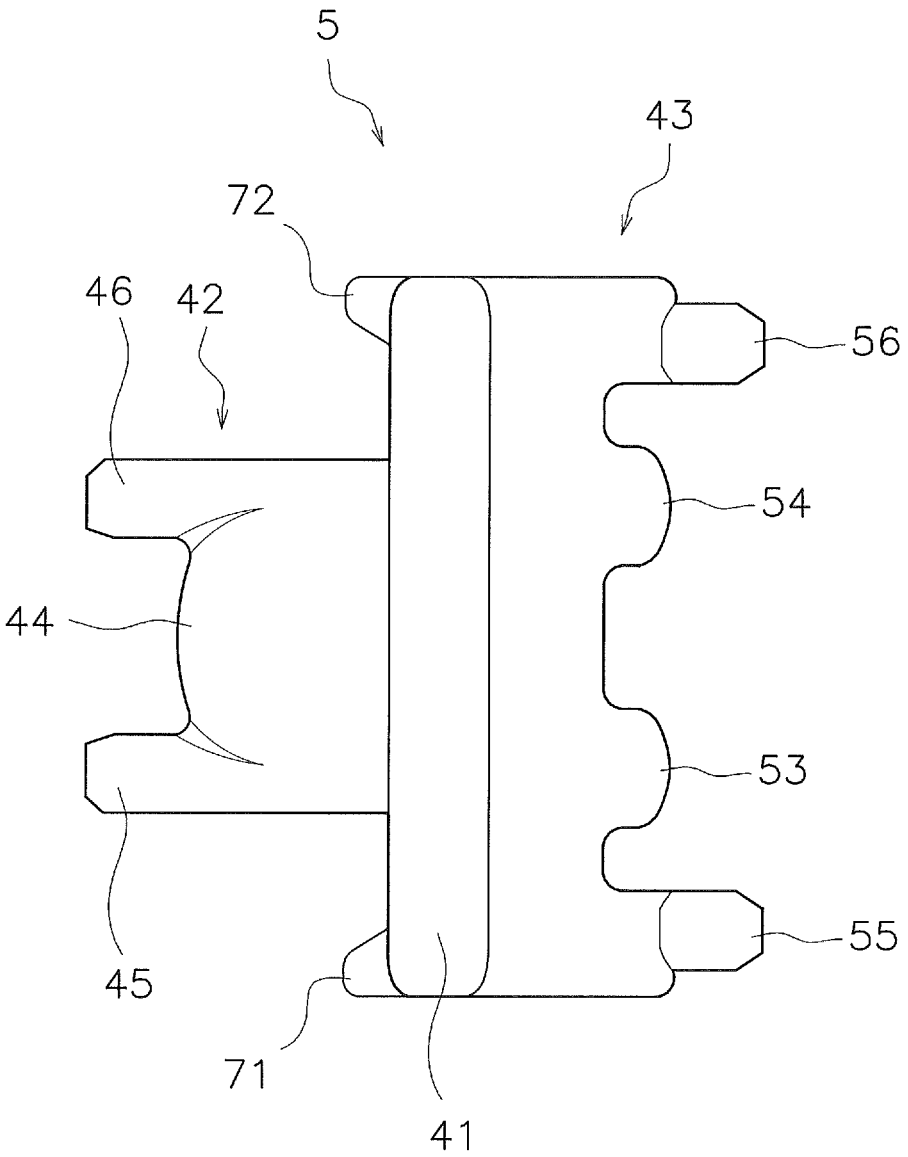
FIG. 6 is a top view of the card.

The card 5 is disposed between the drive unit 4 and the movable contact piece 13. The card 5 transmits the operation of the armature 18 to the movable contact piece 13. The card 5 is made of resin. FIGS. 4 and 5 are perspective views of the card 5. FIG. 6 is a top view of the card 5. As illustrated in FIGS. 4 to 6, the card 5 includes a card body 41, a first contact part 42, and a second contact part 43. The card body 41 has a plate-like shape extending in the up-down direction.

Figure 7:
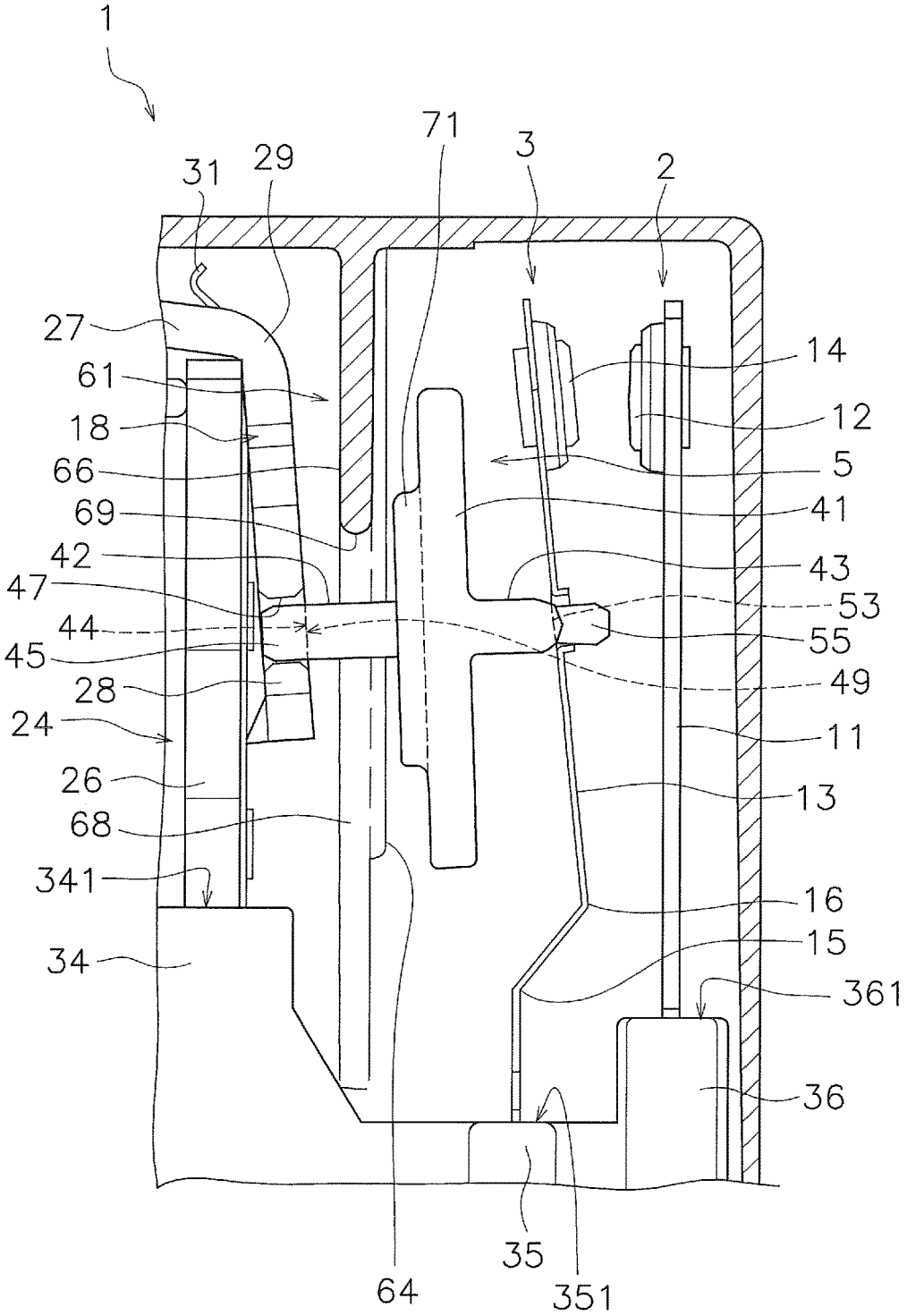
FIG. 7 is an enlarged front view of the relay.

FIG. 7 is an enlarged front view of the relay showing a structure around the card. As illustrated in FIG. 7, the card body 41 is disposed between the movable contact piece 13 and the second portion 28 of the armature 18. The first contact part 42 extends from the card body 41 toward the armature 18. The first contact part 42 is disposed to face the second portion 28 of the armature 18. The first contact part 42 is connected to the second portion 28 of the armature 18. The second contact part 43 is disposed to face the movable contact piece 13. The second contact part 43 is connected to the movable contact piece 13.

As illustrated in FIG. 6, the first contact part 42 includes a central contact portion 44, a first extending portion 45, and a second extending portion 46. The first extending portion 45 is disposed on one side of the central contact portion 44 and extends toward the drive unit 4 further than the central contact portion 44 does. The second extending portion 46 is disposed on the other side of the central contact portion 44 and extends toward the drive unit 4 further than the central contact portion 44 does. The central contact portion 44 has a shape that is convexly curved toward the armature 18.

Figure 8:
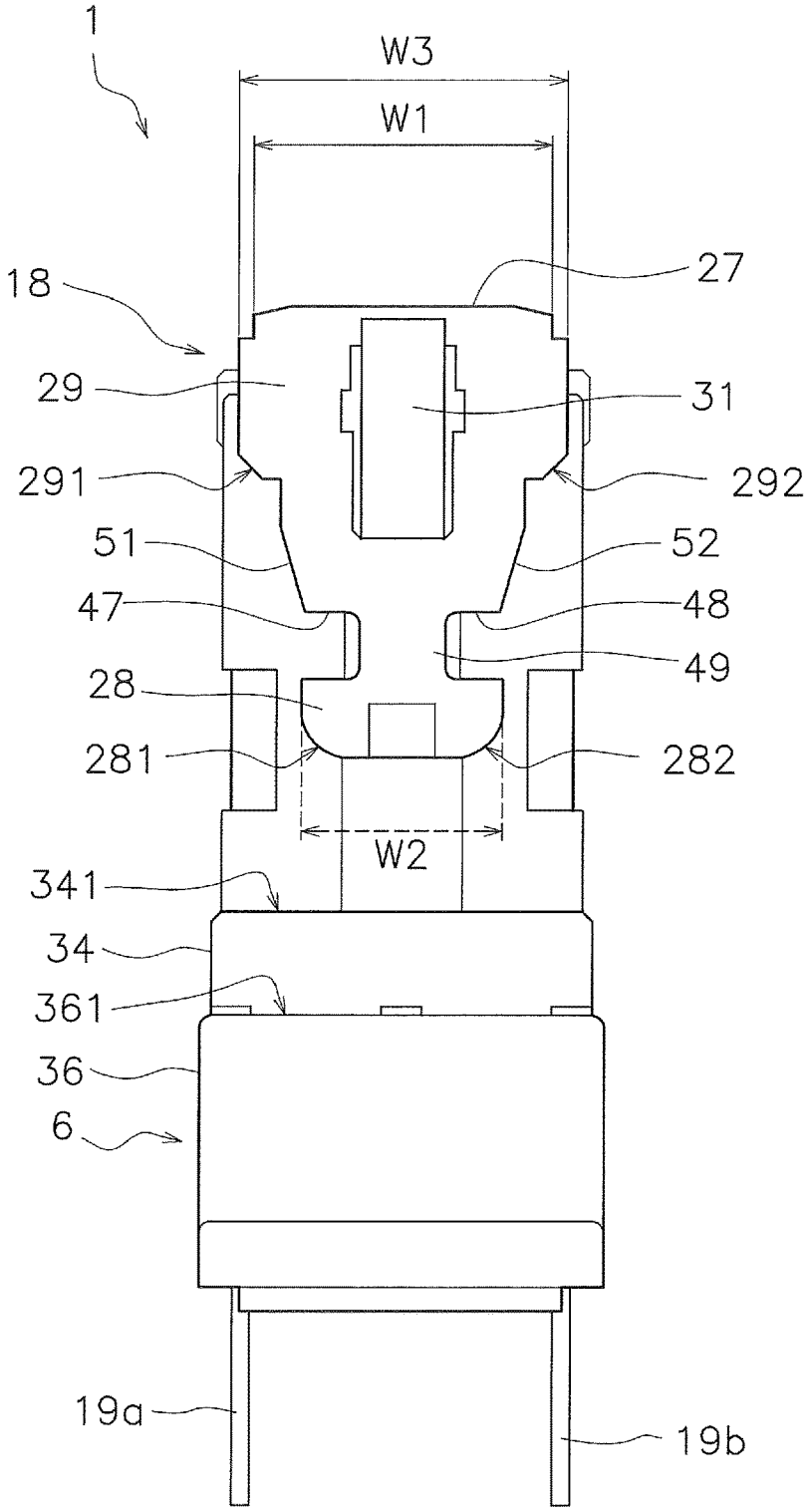
FIG. 8 is a side view of the relay showing an armature.
Figure 9:
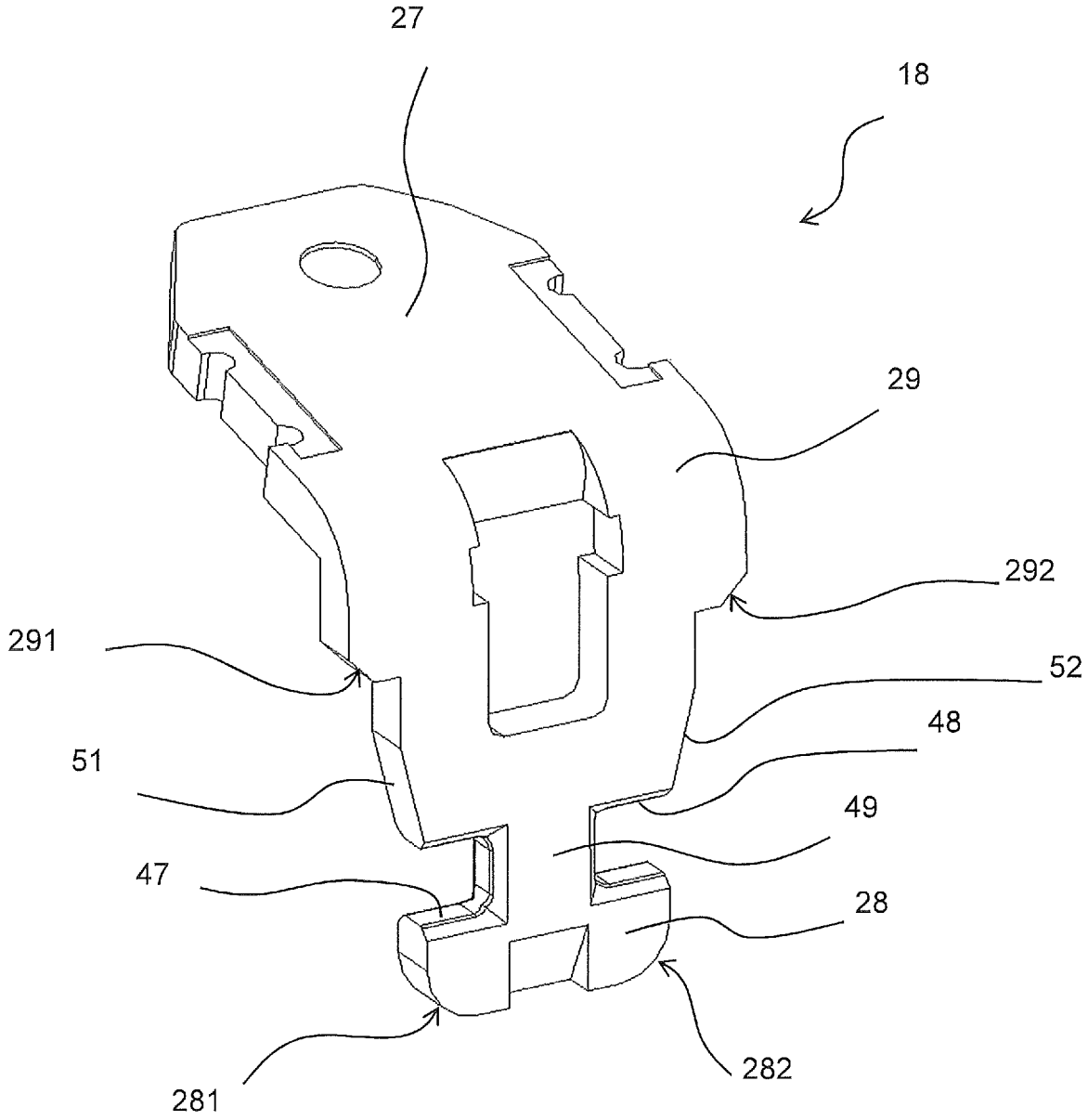
FIG. 9 is a perspective view of the armature.

FIG. 8 is a side view of the relay 1. FIG. 9 is a perspective view of the armature 18. In FIG. 8, the case 7, the fixed contact unit 2, the movable contact unit 3, and the card 5 are not shown. As illustrated in FIG. 8, the width W2 of the second portion 28 of the armature 18 is smaller than the width W1 of the first portion 27. The width W2 of the second portion 28 is smaller than the width W3 of the third portion 29. Steps 291 and 292 between the second portion 28 and the third portion 29 are chamfered. The corners 281 and 280 at the lower end of the second portion 28 are chamfered. The chamfers are not limited to an angled shape as illustrated in FIG. 8, and may be a round shape.

The second portion 28 of the armature 18 includes tapered portions 51 and 52. The tapered portion 51 is provided between the third portion 29 and a first recess 47. The tapered portion 52 is provided between the third portion 29 and a second recess 48. The tapered portions 51 and 52 have a shape that tapers toward the lower end of the second portion 28.

The second portion 28 of the armature 18 includes the first recess 47, the second recess 48, and a pressing portion 49. The pressing portion 49 is disposed between the first recess 47 and the second recess 48. As illustrated in FIG. 7, the first extending portion 45 of the card 5 is disposed in the first recess 47. Similarly, the second extending portion 46 of the card 5 is disposed in the second recess 48. The pressing portion 49 is disposed between the first extending portion 45 and the second extending portion 46. The pressing portion 49 is disposed to face the central contact portion 44 of the first contact part 42. When the armature 18 rotates so that the first portion 27 comes closer to the iron core 23, the pressing portion 49 contacts and presses the central contact portion 44 of the first contact part 42. This causes the operation of the armature 18 to be transmitted to the card 5.

As illustrated in FIGS. 4 to 6, the second contact part 43 includes a first pressing portion 53, a second pressing portion 54, a first connecting portion 55, and a second connecting portion 56. The first pressing portion 53 and the second pressing portion 54 protrude from a tip of the second contact part 43 toward the movable contact piece 13. The first pressing portion 53 and the second pressing portion 54 are disposed to face the movable contact piece 13. The first pressing portion 53 and the second pressing portion 54 contact the movable contact piece 13 and press the movable contact piece 13. The first connecting portion 55 and the second connecting portion 56 protrude from the tip of the second contact part 43 toward the movable contact piece 13. The first connecting portion 55 and the second connecting portion 56 are connected to the movable contact piece 13.

As illustrated in FIG. 1, the case 7 is put on the base 6. The case 7 is made of an insulating material. The case 7 is made of resin. The case 7 may be formed of a material other than resin. As illustrated in FIG. 1, the case 7 has a wall 61. The wall 61 is disposed between the armature 18 and the card 5. The wall 61 is formed integrally with the case 7. The wall 61 may be separate from the case 7.

Figure 10:
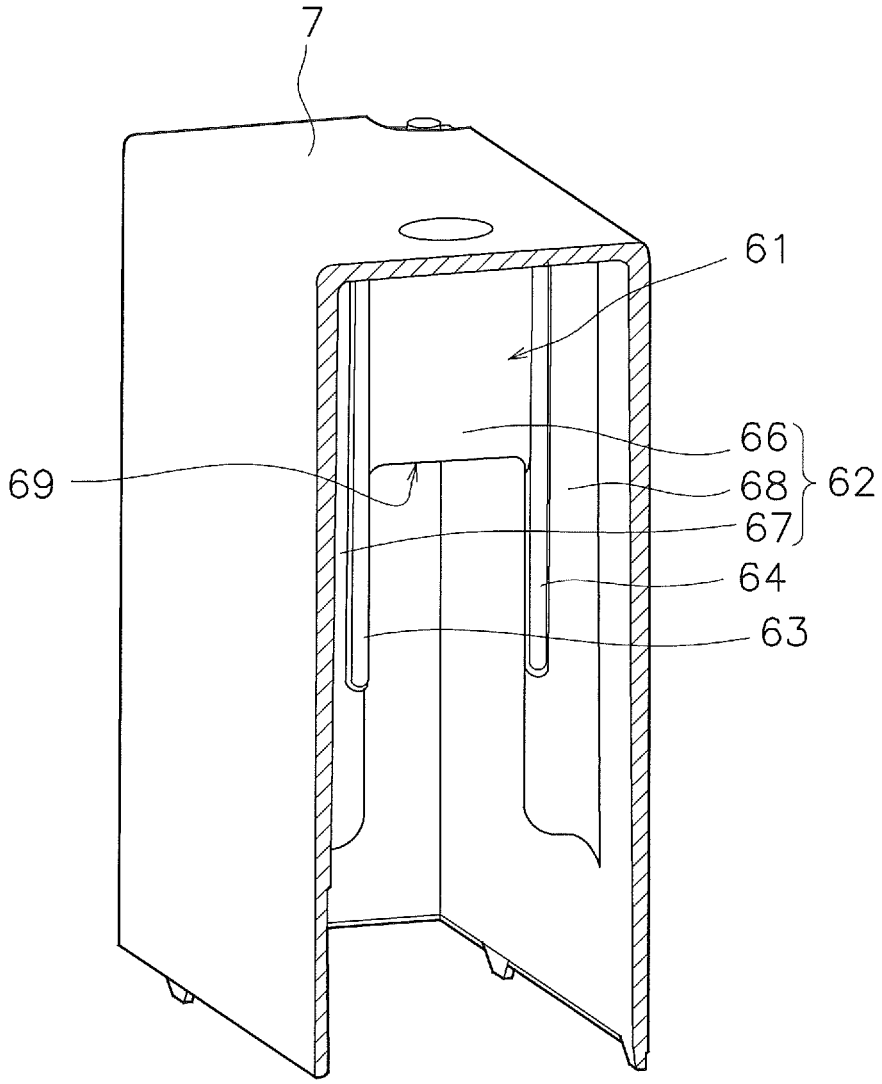
FIG. 10 is a cross-sectional view of a case.

FIG. 10 is a perspective view showing a cross section of the case 7. As illustrated in FIG. 10, the wall 61 includes a wall body 62, a first wall protrusion 63, and a second wall protrusion 64. The wall body 62 extends in a direction intersecting the direction from the card 5 toward the drive unit 4. The wall body 62 extends in the up-down direction and is disposed between the armature 18 and the card 5.

The wall body 62 includes an upper wall portion 66, a first side wall portion 67, and a second side wall portion 68. The upper wall portion 66 is located above the first contact part 42. The first side wall portion 67 extends from the upper wall portion 66 through one side of the first contact part 42, to a location below the first contact part 42. The second side wall portion 68 extends from the upper wall portion 66 through the other side of the first contact part 42, to a location below the first contact part 42. The upper wall portion 66, the first side wall portion 67, and the second side wall portion 68 form a shape that is recessed upward.

The first wall protrusion 63 and the second wall protrusion 64 protrude from the wall body 62 toward the card 5. The first wall protrusion 63 and the second wall protrusion 64 extend in the up-down direction. A part of the first wall protrusion 63 is disposed along the first side wall portion 67. A part of the second wall protrusion 64 is disposed along the second side wall portion 68.

Figure 11:
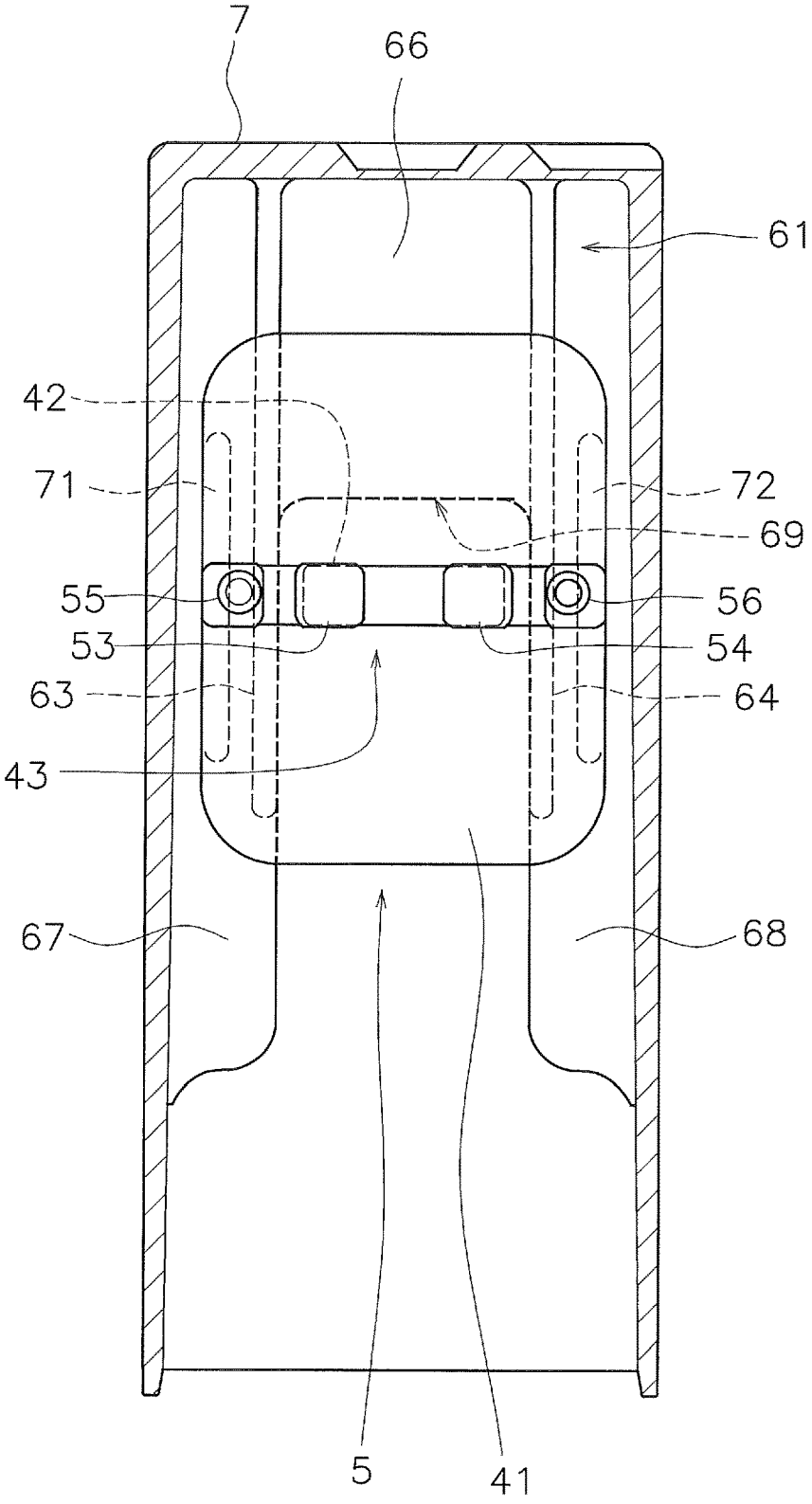
FIG. 11 is a side view showing the case and the card.

FIG. 11 is a side view showing the wall 61 and the card 5. As illustrated in FIG. 11, the first wall protrusion 63 and the second wall protrusion 64 extend from a location above the lower end 69 of the upper wall portion 66 to a location below the lower end 69 of the upper wall portion 66. The first wall protrusion 63 and the second wall protrusion 64 extend from a location above the first contact part 42 to a location below the first contact part 42. As illustrated in FIG. 7, the first wall protrusion 63 and the second wall protrusion 64 extend to a location below the lower end of the armature 18.

The card body 41 is disposed between the wall 61 and the movable contact piece 13. As illustrated in FIGS. 4 to 6, the card 5 includes a first card protrusion 71 and a second card protrusion 72. The first card protrusion 71 and the second card protrusion 72 protrude from the card body 41 toward the wall 61. The first card protrusion 71 is disposed on one side of the first contact part 42. The second card protrusion 72 is disposed on the other side of the first contact part 42.

The first card protrusion 71 and the second card protrusion 72 extend in the up-down direction. As illustrated in FIG. 11, the first card protrusion 71 and the second card protrusion 72 extend from a location above the first contact part 42 to a location below the first contact part 42. The first card protrusion 71 and the second card protrusion 72 extend from a location above the lower end 69 of the upper wall portion 66 to a location below the lower end 69 of the upper wall portion 66. As illustrated in FIG. 7, the first card protrusion 71 and the second card protrusion 72 extend to a location below the lower end of the armature 18.

Figure 12:
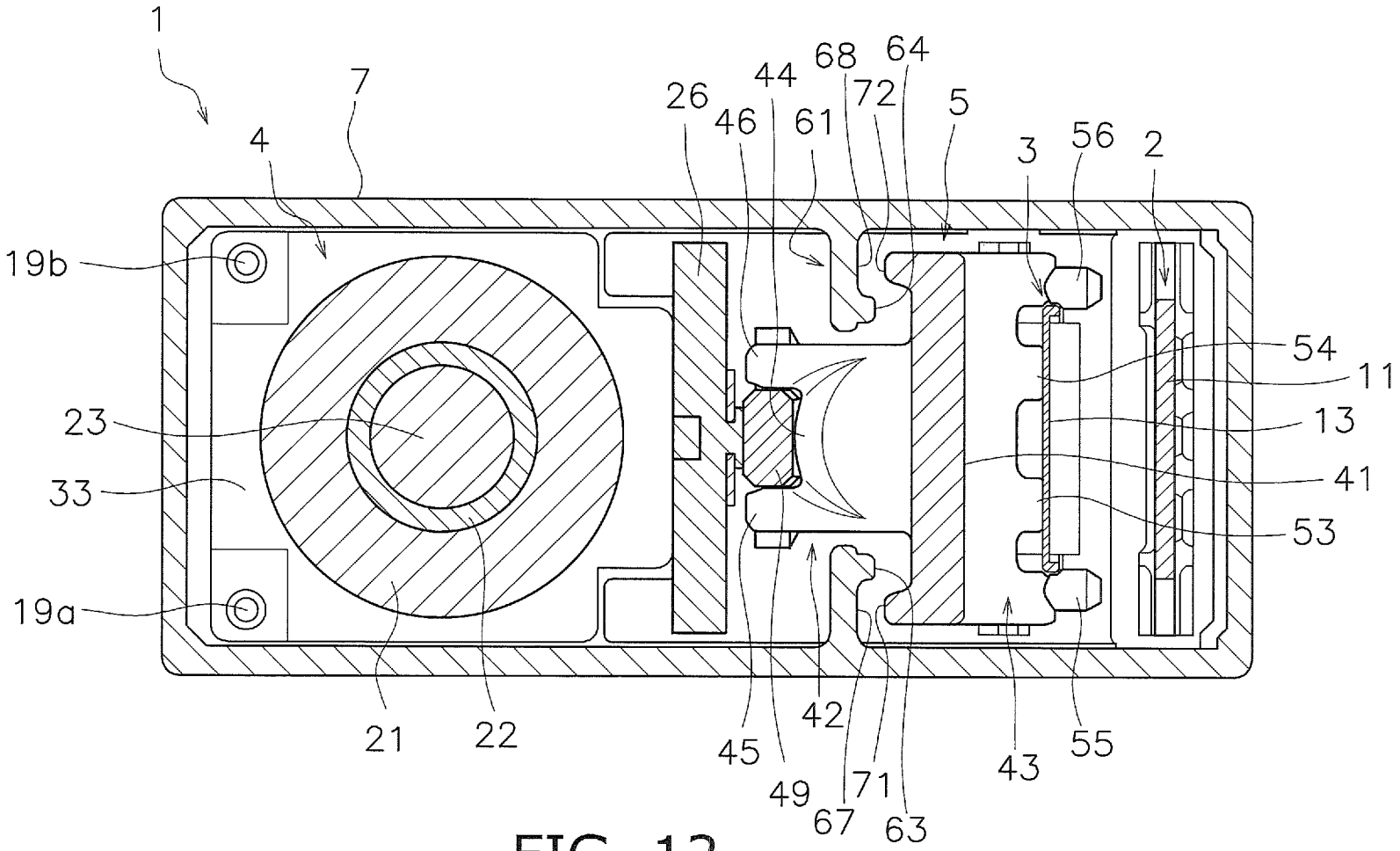
FIG. 12 is a cross-sectional view taken along the line XII-XII in FIG. 3.

FIG. 12 is a cross-sectional view taken along the line XII-XII in FIG. 3. As illustrated in FIG. 12, at least a part of the first card protrusion 71 is disposed to face the first side wall portion 67. At least a part of the second card protrusion 72 is disposed to face the second side wall portion 68. The first card protrusion 71 is disposed outside the first wall protrusion 63 in the width direction. The second card protrusion 72 is disposed outside the second wall protrusion 64 in the width direction.

As illustrated in FIG. 11, when viewed in a direction from the movable contact piece 13 toward the drive unit 4, at least a part of the first card protrusion 71 overlaps the wall 61. When viewed in the direction from the movable contact piece 13 toward the drive unit 4, at least a part of the second card protrusion 72 overlaps the wall 61. When viewed in the direction from the movable contact piece 13 toward the drive unit 4, at least a part of the first card protrusion 71 overlaps the first side wall portion 67. When viewed in the direction from the movable contact piece 13 toward the drive unit 4, at least a part of the second card protrusion 72 overlaps the second side wall portion 68.

Next, the operation of the relay 1 will be described. When the coil 21 is not energized and the drive unit 4 is demagnetized, the armature 18 is not attracted to the iron core 23. In this state, as illustrated in FIG. 7, the movable contact 14 is separated from the fixed contact 12 by an elastic force of the movable contact piece 13.

When the coil 21 is energized and the drive unit 4 is excited, the armature 18 is attracted to the iron core 23, and rotates about the upper end of the yoke 24 in an ON direction (counterclockwise in FIG. 7) against the elastic force of the movable contact piece 13. When the armature 18 rotates in the ON direction, the pressing portion 49 of the armature 18 presses the central contact portion 44 of the card 5. Then, the card 5 moves in the ON direction (to the right in FIG. 7), whereby the first pressing portion 53 and the second pressing portion 54 of the card 5 press the movable contact piece 13 to bring the movable contact 14 closer to the fixed contact 12. As a result, the movable contact 14 is pressed against and comes into contact with the fixed contact 12.

On the contrary, when the coil 21 is de-energized and the drive unit 4 is demagnetized, the first portion 27 of the armature 18 rotates in an OFF direction (clockwise in FIG. 7) to be separated from the iron core 23 by the elastic force of the movable contact piece 13. When the armature 18 rotates in the OFF direction, the pressing portion 49 of the armature 18 moves in a direction away from the central contact portion 44 of the card 5. Then, the card 5 is moved in the OFF direction (to the left in FIG. 7) by the elastic force of the movable contact piece 13, whereby the first pressing portion 53 and the second pressing portion 54 of the card 5 move in a direction to bring the movable contact 14 separate from the fixed contact 12. As a result, the movable contact 14 separates from the fixed contact 12.

With the relay 1 according to the present embodiment described above, as illustrated in FIG. 12, the wall 61 is disposed between the armature 18 and the card 5. Accordingly, it is possible to increase an insulation distance between the movable contact piece 13 and the armature 18 while suppressing an increase in the size of the relay 1. Further, the card 5 is provided with the first card protrusion 71 and the second card protrusion 72 protruding from the card body 41 toward the wall 61. Accordingly, it is possible to further increase the insulation distance between the movable contact piece 13 and the armature 18 while suppressing an increase in the size of the relay 1.

The first card protrusion 71 and the second card protrusion 72 extend in the up-down direction. The first card protrusion 71 and the second card protrusion 72 extend from a location above the first contact part 42 to a location below the first contact part 42. The first card protrusion 71 and the second card protrusion 72 extend from a location above the lower end 69 of the upper wall portion 66 to a location below the lower end 69 of the upper wall portion 66. In this way, the first card protrusion 71 and the second card protrusion 72 greatly extend in the up-down direction, so that the insulation distance can be further increased.

The wall 61 is provided with a first wall protrusion 63 and a second wall protrusion 64 that protrude from the wall body 62 toward the card 5. With the configuration, it is possible to increase the insulation distance between the movable contact piece 13 and the armature 18 while suppressing an increase in the size of the relay 1.

The first wall protrusion 63 and the second wall protrusion 64 extend in the up-down direction. The first wall protrusion 63 and the second wall protrusion 64 extend from a location above the lower end 69 of the upper wall portion 66 to a location below the lower end 69 of the upper wall portion 66. The first wall protrusion 63 and the second wall protrusion 64 extend from a location above the first contact part 42 to a location below the first contact part 42. In this way, the first wall protrusion 63 and the second wall protrusion 64 greatly extend in the up-down direction, so that the insulation distance between the movable contact piece 13 and the armature 18 can be further increased.

The wall 61 includes the first side wall portion 67 and the second side wall portion 68 extending in the up-down direction. Since the first side wall portion 67 and the second side wall portion 68 greatly extend in the up-down direction, the insulation distance between the movable contact piece 13 and the armature 18 can be increased.

When viewed in a direction from the movable contact piece 13 toward the drive unit 4, at least a part of the first card protrusion 71 and at least a part of the second card protrusion 72 overlap the wall 61. Further, at least a part of the first card protrusion 71 is disposed to face the first side wall portion 67. At least a part of the second card protrusion 72 is disposed to face the second side wall portion 68. With the configuration, the insulation distance between the movable contact piece 13 and the armature 18 can be further increased.

The armature 18 is held at both sides by the first extending portion 45 and the second extending portion 46. Therefore, the central contact portion 44 of the card 5 can be stably pressed by the armature 18. Further, the central contact portion 44 has a shape that is convexly curved toward the armature 18. Therefore, the central contact portion 44 of the card 5 can be pressed more stably by the armature 18.

The width W2 of the second portion 28 of the armature 18 is smaller than the width W1 of the first portion 27. The width W2 of the second portion 28 is smaller than the width W3 of the third portion 29. Therefore, the insulation distance between the movable contact piece 13 and the armature 18 can be further increased. Further, since the width W1 of the first portion 27 facing the iron core 23 can be made large, magnetic loss in the armature 18 can be suppressed. Further, the width W3 of the third portion 29 connecting the first portion 27 and the second portion 28 can be made large. Therefore, it is possible to suppress a decrease in strength of the armature 18.

The first extending portion 45 is disposed in the first recess 47 of the armature 18, and the second extending portion 46 is disposed in the second recess 48. Therefore, the first extending portion 45 and the second extending portion 46 can be disposed on both sides of the armature 18 with the width W2 of the second portion 28 being reduced. As a result, it is possible to increase the insulation distance between the movable contact piece 13 and the armature 18 while suppressing an increase in the size of the relay 1.

Although one embodiment of the present invention has been described above, the present invention is not limited to the above embodiment, and various modifications can be made without departing from the scope of the invention.

A configuration of the contact of the relay 1 is not limited to the above, and may be altered. In the above embodiment, a protrusion is provided to both the card 5 and the wall 61. However, a protrusion may be provided to either the card 5 or the wall 61. Alternatively, a protrusion may be provided to the wall 61 only.

A configuration of the fixed contact unit 2 may be altered. For example, the shape or arrangement of the fixed terminal 11 may be altered. A configuration of the movable contact unit 3 may be altered. For example, the shape or the arrangement of the movable contact piece 13 may be altered. A configuration of the drive unit 4 may be altered. For example, the shape or arrangement of the coil 21 may be altered. The shape or arrangement of the armature 18 or the yoke 24 may be altered.

The shape or arrangement of the card 5 may be altered. The shape or the arrangement of the first card protrusion 71 and the second card protrusion 72 may be altered.

The shape or arrangement of the first contact part 42 may be altered. The shape or arrangement of the second contact part 43 may be altered.

The shape or arrangement of the base 6 may be altered. For example, the shape or the arrangement of the coil placement portion 33, the yoke support portion 34, the contact piece support portion 35, and the fixed terminal support portion 36 may be altered.

The shape or arrangement of the case 7 may be altered. For example, the shape or arrangement of the wall 61 may be altered. The shape or arrangement of the first wall protrusion 63 and the second wall protrusion 64 may be altered.

REFERENCE NUMERALS

4: Drive unit, 5: Card, 6: Base, 11: Fixed terminal, 12: Fixed contact, 13: Movable contact piece, 14: Movable contact, 18: Armature, 21: Coil, 23: Iron core, 27: First portion, 28: Second portion, 29: Third portion, 41: Card body, 42: First contact part, 44: Central contact portion, 45: First extending portion, 46: Second extending portion, 47: First recess, 48: Second recess, 62: Wall body, 61: Wall, 63: First wall protrusion, 66: Upper wall portion, 67: First side wall portion, 71: First card protrusion

The invention claimed is:

1. A relay comprising:

a fixed terminal;

a fixed contact connected to the fixed terminal;

a movable contact piece disposed to face the fixed terminal;

a movable contact connected to the movable contact piece and disposed to face the fixed contact;

a drive unit including a coil and an armature, the armature configured to operate by electromagnetic force that is generated from the coil;

a base that supports the fixed terminal, the movable contact piece, and the drive unit;

a card disposed between the drive unit and the movable contact piece, the card configured to transmit an operation of the armature to the movable contact piece; and a wall disposed between the armature and the card, wherein the card includes a card body disposed between the wall and the movable contact piece, a contact part extending from the card body toward the armature, the contact part being configured to contact the armature, and a protrusion that protrudes from the card body toward the wall, the protrusion being disposed on a side of the contact part, the protrusion extending in an up-down direction including an upward direction and a downward direction, the upward direction being a direction in which the movable contact piece extends from the base, and the downward direction being an opposite direction to the upward direction, the wall includes an upper wall portion located above the contact part, and a side wall portion extending from the upper wall portion through the side of the contact part to below the contact part, and at least a part of the protrusion is disposed to face the side wall portion.

2. The relay according to claim 1, wherein the protrusion extends from above the contact part to below the contact part.

3. The relay according to claim 1, wherein the protrusion extends from above a lower end of the upper wall portion to below the lower end of the upper wall portion.

4. The relay according to claim 1, wherein when viewed in a direction from the movable contact piece toward the drive unit, at least a part of the protrusion overlaps the wall.

5. The relay according to claim 1, wherein the contact part includes a central contact portion, a first extending portion disposed on one side of the central contact portion, the first extending portion extending toward the drive unit further than the central contact portion does, and a second extending portion disposed on the other side of the central contact portion, the second extending portion extending toward the drive unit further than the central contact portion does, and the armature is configured to operate by the electromagnetic force to press the central contact portion.

6. The relay according to claim 5, wherein the central contact portion has a shape that is convexly curved toward the armature.

7. The relay according to claim 5, wherein the drive unit further includes an iron core inserted into the coil, the armature includes a first portion disposed to face the iron core, a second portion disposed to face the contact part, and a third portion disposed between the first portion and the second portion, and the second portion has a smaller width than the first portion.

8. The relay according to claim 7, wherein the second portion has a smaller width than the third portion.

9. The relay according to claim 7, wherein the second portion includes a first recess in which the first extending portion is disposed, and a second recess in which the second extending portion is disposed.

10. A relay comprising:

a fixed terminal;

a fixed contact connected to the fixed terminal;

a movable contact piece disposed to face the fixed terminal;

a movable contact attached to the movable contact piece and disposed to face the fixed contact;

a drive unit including a coil and an armature, the armature configured to operate by electromagnetic force that is generated from the coil;

a base that supports the fixed terminal, the movable contact piece, and the drive unit;

a card disposed between the drive unit and the movable contact piece, the card configured to transmit an operation of the armature to the movable contact piece; and a wall disposed between the armature and the card, wherein the wall includes a wall body extending in a direction intersecting a direction from the card to the drive unit, and a protrusion protruding from the wall body toward the card, the protrusion extending in an up-down direction including an upward direction and a downward direction, the upward direction being a direction in which the movable contact piece extends from the base, and the downward direction being an opposite direction to the upward direction, the card includes a card body disposed between the wall and the movable contact piece, and a contact part extending from the card body toward the armature, the contact part configured to contact the armature, and the wall body includes an upper wall portion located above the contact part, and a side wall portion extending from the upper wall portion through a side of the contact part to below the contact part, and at least a part of the protrusion is disposed to face the card body, at least the part of the protrusion being further disposed along the side wall portion.

11. The relay according to claim 10, wherein the protrusion extends from above a lower end of the upper wall portion to below the lower end of the upper wall portion.

12. The relay according to claim 10, wherein the protrusion extends from above the contact part to below the contact part.

* * * * *